United States Patent [19]

Szupillo

[11] 4,180,723

[45] Dec. 25, 1979

[54] ELECTRICAL CONTACTS FOR ELECTRICALLY CONDUCTIVE CARBON GLASSES

[75] Inventor: Raymond E. Szupillo, Big Flats, N.Y.

[73] Assignee: Corning Glass Works, Corning, N.Y.

[21] Appl. No.: 781,771

[22] Filed: Mar. 28, 1977

[51] Int. Cl.[2] ..... H05B 3/08

[52] U.S. Cl. ..... 219/541; 219/300; 174/94 R; 339/30; 338/55; 338/332

[58] Field of Search ..... 219/541, 547, 522, 300; 174/94 R; 65/50, 49; 106/52, 54; 339/30, 251, 256 R, 256 A; 338/55, 316, 332, 334

[56] References Cited

U.S. PATENT DOCUMENTS

| | | | |
|---|---|---|---|
| 1,635,831 | 7/1927 | Gagnon | 339/30 |
| 3,105,136 | 9/1963 | Ashenfarb | 219/541 |
| 3,175,181 | 3/1965 | Grabbe | 339/278 C |
| 3,349,296 | 10/1967 | Patalong | 174/94 R |
| 3,511,921 | 5/1970 | Pasternak | 339/278 |
| 3,775,078 | 11/1973 | Elmer et al. | 219/547 |
| 3,813,232 | 5/1974 | Forker, Jr. | 219/547 |

*Primary Examiner*—Bruce A. Reynolds
*Assistant Examiner*—M. Paschall
*Attorney, Agent, or Firm*—Clarence R. Patty, Jr.; Clinton S. Janes, Jr.; Kees van der Sterre

[57] ABSTRACT

High-use-temperature electrical contacts for carbon-containing glasses which include a soft, glass-adherent metal layer in contact with the carbon phase in the glass and a compression electrode positioned over the metal layer which maintains compressive stress between the layer and the glass at temperatures up to and including the contact use temperature are described. Electrical circuit elements comprising one or more of such contacts offer stable electrical performance after repeated cycling to high temperatures.

17 Claims, 16 Drawing Figures

ELECTRICAL CONTACTS FOR ELECTRICALLY CONDUCTIVE CARBON GLASSES

BACKGROUND OF THE INVENTION

The present invention relates to electrical circuit elements made of carbon-containing glasses and is particularly concerned with electrical contact systems for such circuit elements which resist deterioration during exposure to high temperatures.

Glasses comprising an electrically conductive carbon phase are known, being first described by R. B. Ellis in U.S. Pat. No. 2,556,616. In general, such glasses are prepared by impregnating a porous glass body with one or more ingredients which can subsequently be decomposed to carbon. The porous glass body is typically a porous 96% silica glass body provided in accordance with the teachings of U.S. Pat. No. 2,106,744 to Hood et al.

The porous glass is impregnated by immersion into a solution or mixture comprising a suitable organic compound and is then heated to a temperature sufficient to decompose compound remaining in the pore structure to carbon. Thereafter, a high-temperature heating step under non-oxidizing conditions is used to consolidate the porous glass (collapse the pores), sealing in the conductive carbon phase and protecting it from subsequent oxidation. The electrical properties of the resulting product, which consists of a glass matrix surrounding a continuous, interconnected, thread-like carbon phase of comparatively low volume, are quite stable up to the pore consolidation temperature used in production.

Following the work of Ellis, a number of alternate methods for providing carbon-containing glasses from porous glasses, and particularly porous 96% silica glasses, were developed. U.S. Pat. No. 3,813,232 to Forker et al. and U.S. Pat. No. 3,775,078 to Elmer et al., among others, describe some of the alternate methods which have been employed.

Prior art carbon impregnation methods are generally suitable for introducing carbon into continuously porous ceramics or glasses regardless of the particular composition thereof. However, porous glasses of the type known in the art as 96% silica glasses are preferred from the standpoint of processing convenience, and provide desirable properties in the product. As in the prior art, the designation 96% silica glass is used herein in the generic sense to refer to all highly siliceous glasses produced by the method of the aforementioned Hood et al. patent, regardless of the exact silica content of the glass.

Carbon-containing glasses made from 96% silica glasses are low in thermal expansion and quite refractory, and having stable electrical properties can therefore function as electrical circuit elements at very high temperatures. However, difficulties in providing long term electrical contact with the carbon phase in the glass, even at moderate temperatures, are encountered.

Known methods for providing electrical contact with carbon-containing glasses usually involve the application of conductive graphite or metal-containing pastes or solutions to the glass to make contact with the exposed carbon phase. Alternatively, electroplating methods can be used to coat the exposed carbon with copper or other metals.

Contacts provided by these and similar methods usually deteriorate rapidly during thermal cycling. A major factor accelerating deterioration is the thermal expansion mismatch between low-expansion carbon-containing 96% silica glass (less than about 0.00009 percent per degree centigrade) and most metals useful for contacts (in the range of about 0.0007–0.0030 percent per degree centigrade). High expansion metals tend to break away from the largely glass contact surface area during temperature cycling, reducing the area of electrical contact and increasing current density. The resulting heating causes further thermal stress, and deterioration accelerates until destructive breakdown is complete.

It is the principal object of the present invention to provide an electrical contact for carbon-containing glass which resists deterioration even at high use temperatures and during repeated thermal cycling.

It is a further object of the invention to provide electrical circuit elements consisting of carbon-containing glass which include one or more electrical contacts suitable for use at high temperatures.

It is a further object of the invention to provide electrical heating elements which include high-use-temperature contacts which withstand extended thermal cycling.

Other objects and advantages of the invention will become apparent from the following description thereof.

SUMMARY OF THE INVENTION

In accordance with the present invention, a high-use-temperature electrical contact for carbon-containing glass is provided by utilizing separate contact elements to control the mechanical and electrical contact functions essential to long life. By high-use-temperature contact is meant a contact which can operate successfully and repeatedly at temperatures in excess of about 200° C.

The contact of the invention first comprises a continuous layer of a soft, glass-adherent metal which is deposited on the glass in contact with the carbon phase therein, to provide the electrical connection with that carbon phase. For the purposes of the present description, a glass-adherent metal is a metal which wets and adheres to glass when molten, and a soft metal or alloy is one having a Mohs hardness not exceeding about 2. Examples of soft, glass-adherent metals are indium, gallium, thallium, lead, and soft metal alloys consisting at least predominantly of one or more of these metals.

The contact of the invention further comprises a metallic compression electrode positioned over the soft metal layer and in electrical contact therewith, which electrode is adapted to maintain compressive stress between the layer and the underlying carbon-containing glass at all temperatures up to and including the designed use temperature of the contact. The compression electrode maintains the mechanical integrity of the contact, preventing oxidation of the carbon phase at high temperature, and is the contact element to which an electric potential from an external source is applied to the carbon-containing glass.

Through the use of electrical contacts comprising a soft metal layer and a compression electrode as described electrical circuit elements consisting of carbon-containing 96% silica glass suitable for high temperature use may be provided. Temperature sensors, refractory resistors, and electrical resistance heaters are examples of circuit elements which may advantageously include these high-use-temperature contacts.

A particularly demanding use for such contacts is in the fabrication of carbon glass electrical resistance heating elements. Such elements typically consist of a cylindrical body fabricated of carbon-containing 96% silica glass to which one or more high-use-temperature contacts are applied. The carbon-containing porous glass body may be a rod but is usually a cylindrical tube which is used to heat liquids or fluids passing therethrough. For a more complete description of fluid-heating devices of this type, reference may be made to the copending commonly assigned application of R. B. Forker and J. W. Panzarino, Ser. No. 782,233, filed concurrently herewith.

High-use-temperature contacts for such rods or tubes are provided by applying the continuous layer of soft, glass-adherent metal as a circumferential band encircling the rod or tube and providing electrical contact with the carbon phase therein. The subsequently applied metallic compression electrode for the heating element consists of a circumferential ring structure positioned over and in electrical contact with the band, which is adapted to maintain compressive stress between the band and the underlying glass body of the heating element at all temperatures up to and including the designed use temperature of the contact.

Because the ring forming the compression electrode is composed of metal, it expands more rapidly than the carbon-containing glass as the temperature of the heating element increases during use. The ring structure must therefore be of a diameter small enough to be effective to maintain stress on the metal band despite expansion in use, or it must include means for overcoming thermal expansion effects so that compressive stress is maintained at use temperatures. Unitary rings of a size effective to maintain compressive stress on the band at use temperatures are typically applied while expanded by heating to a temperature exceeding the designed use temperature of the contact. Alternatively, the ring structure may include a split ring together with auxiliary compressing means for maintaining the required compressive stress over a wide temperature range. Such may include external springs for compressing the rings, bimetallic rings which do not expand on heating, or the like.

The peak operating temperature of carbon glass heating elements may be very high, e.g., 500° C., or more, and the contact temperature, while normally somewhat lower, will also be quite high. Thus repeated contact operation at contact temperatures in excess of the melting temperature of the soft, glass-adherent metal layer is possible. This need not unacceptably degrade contact performance, provided that the layer composition and contact configuration restrictions hereinabove set forth are observed.

BRIEF DESCRIPTION OF THE DRAWINGS

The invention may be further understood by reference to the drawings, which illustrate specific embodiments of electrical contacts, heating elements, and ring electrodes provided in accordance therewith, wherein.

DETAILED DESCRIPTION OF THE DRAWINGS

Figure 1:
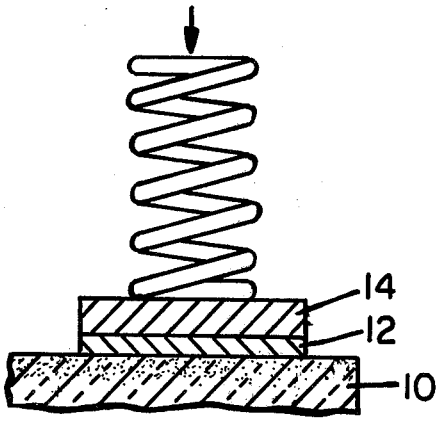
FIG. 1 of the drawings consists of a schematic elevational view in cross-section of an electrical contact provided in accordance with the invention.

FIG. 1 of the drawings consists of a schematic elevational view in cross-section of an electrical contact provided in accordance with the invention. Primary electrical contact with carbon-containing glass substrate 10 having an exposed, electrically conductive carbon phase (dotted region) is provided by layer 12 which consists of a soft, glass-adherent metal such as indium. Sustained physical and electrical contact between layer 12 and the carbon phase in glass 10 is promoted by metal compression electrode 14, positioned over and in contact with layer 12, which maintains compressive stress between layer 12 and substrate 10. The compressive stress exerted by compression electrode 14 is, for the purpose of illustration, shown as being provided by spring compressing means, although clamping or shrink-fitting compression methods may alternatively be employed, as hereinafter more fully described.

Figure 2:
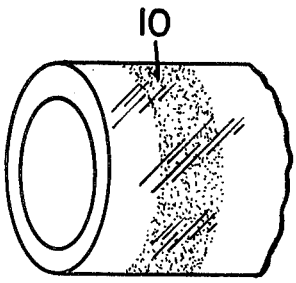
FIGS. 2–2*b* illustrate the application of an electrical contact to a cylindrical carbon glass article of tubular cross-section.
Figure 2A:
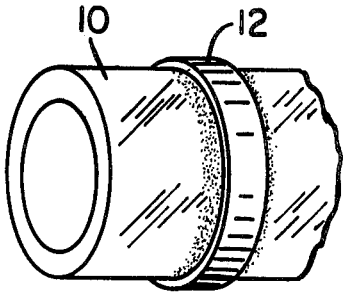
Figure 2B:
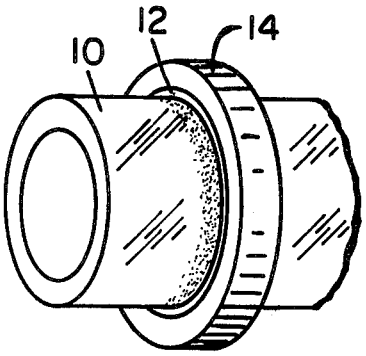

FIGS. 2–2*b* illustrate the application of an electrical contact to a cylindrical carbon glass article of tubular cross-section, useful for example as a heating element for fluids passing therethrough. FIG. 2 consists of a partial schematic perspective view of an end section of a carbon-containing glass tube 10 having an exposed carbon phase (dotted region). In FIG. 2*a,* tube 10 is provided with circumferential band 12 consisting of a continuous layer of a soft, glass-adherent metal which is in contact with the glass and carbon phase. In FIG. 2*b,* a metallic compression electrode 14 consisting of a unitary circumferential ring adapted to maintain compressive stress between metal layer 12 and carbon-glass tube 10 is provided by shrink-fitting over layer 12. An electric potential may be applied to electrode 14 by any suitable means.

Figure 3:
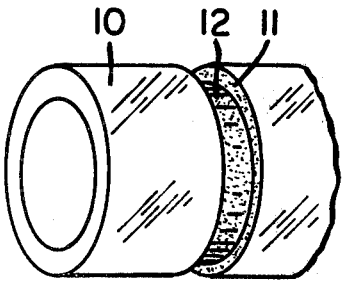
FIGS. 3–3*b* illustrate an alternative electrical contact structure useful with a glass article having a glassy surface layer.
Figure 3A:
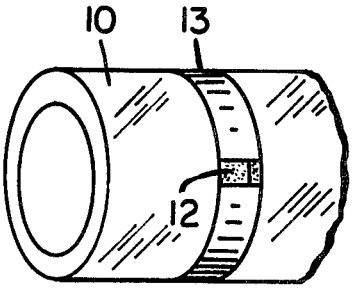
Figure 3B:
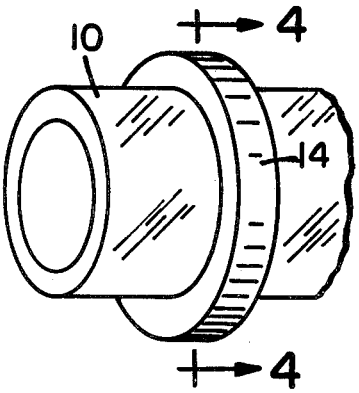

FIGS. 3–3*b* illustrate an alternative electrical contact structure, particularly useful with carbon-containing 96% silica glass having a glassy surface layer covering the conductive carbon phase. FIG. 3 is a partial schematic view in perspective of an end section of such a carbon-containing glass tube 10 wherein the carbon phase (dotted region) has been exposed by grinding a circumferential groove 11 in the exterior surface of the tube. A circumferential band 12 of soft, glass-adherent metal is then provided within groove 11 and in contact with the carbon phase. In FIG. 3*a* an optional metallic-split ring 13, fabricated of thin, electrically conductive sheet metal, is positioned over band 12 to act as a shim at least partially filling groove 11. In FIG. 3*b,* a metallic compression electrode 14 consisting of a circumferential ring adapted to maintain compressive stress on split ring 13 (not shown) and between band 12 (not shown) and glass tube 10 is provided. An electric potential may be applied to electrode 14 by any suitable means.

Figure 4:
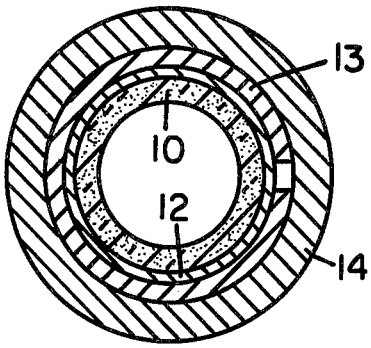
FIG. 4 is an enlarged schematic elevational view in cross-section along line 4–4 of FIG. 3*b;*

FIG. 4 is an enlarged schematic elevational view in cross-section along line 4–4 of FIG. 3*b*, illustrating the relative positioning of the contact elements therein. The circumferential band of soft, glass-adherent metal 12 is maintained in contact with the carbon in tube 10 at all temperatures ranging up to the use temperature of the contact by the action of compression electrode 14 which exerts compressive stress on shim 13, and through shim 13 on band 12.

Figure 5:
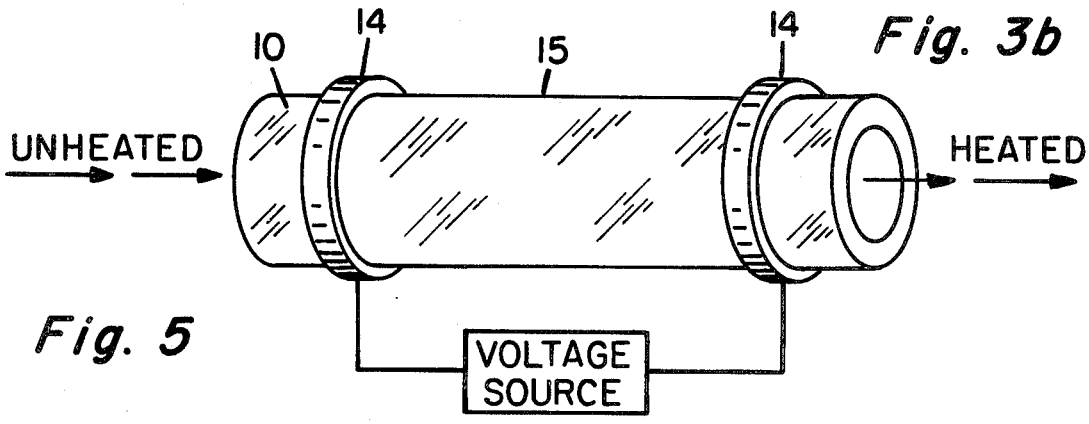
FIG. 5 is a schematic perspective view of a carbon glass electrical heating element comprising electrical contacts in accordance with the invention.

FIG. 5 is a schematic perspective view of a carbon glass electrical heating element 15 comprising electrical contacts provided in accordance with the invention, wherein heating is accomplished by passing unheated fluid into one end of carbon-containing glass tube 10 and extracting heated fluid from the other end of the tube. An electrical voltage from an external voltage source is applied to compression electrodes 14 which are provided at spaced intervals along tube 10 in accordance with FIGS. 2–2*b* or FIGS. 3–3*b* above. Electrical current passing through electrodes 14, the underlying soft metal layers (not shown), and the carbon phase in the glass, heats tube 10 and the fluid passing therethrough.

Figure 6:
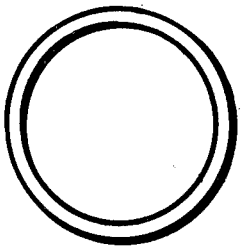
FIGS. 6–6*b* are schematic elevational views of compression electrodes of the circumferential ring type.
Figure 6A:
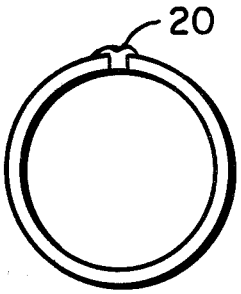
Figure 6B:
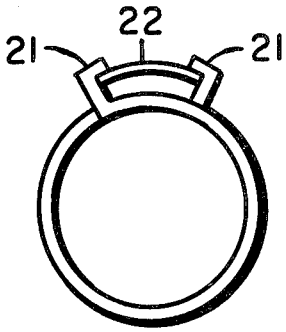

FIGS. 6–6*b* are schematic elevational views of compression electrodes of the circumferential ring type useful in providing contacts according to the invention. FIG. 6 is a compression electrode consisting of a unitary metal ring which could be applied to a cylindrical carbon glass body, for example, by heating to a temperature in excess of the use temperature of the contact to cause expansion to a diameter slightly in excess of the diameter of the carbon glass body and soft metal layer. FIG. 6*a* illustrates a split ring compression electrode which could be applied cold to the carbon glass and then brazed, soldered, or otherwise fastened at joint 20 while maintaining the ring at a temperature somewhat in excess of the use temperature of the contact. FIG. 6*b* illustrates a split ring compression electrode of a type having lugs 21 between which may be inserted metal spacer 22 as the ring is heated while in position on the substrate to a temperature above the use temperature of the contact.

Figure 7:
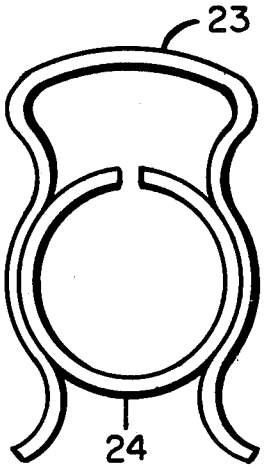
FIGS. 7–7*b* are schematic elevational views of compression electrodes of the circumferential ring type which include auxiliary means for maintaining compressive stress.
Figure 7A:
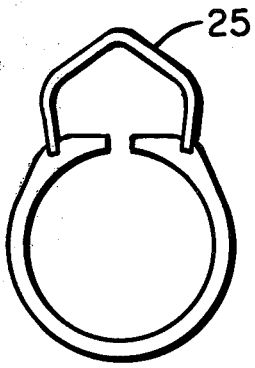
Figure 7B:
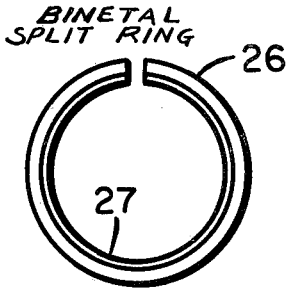

FIGS. 7–7*b* are schematic elevational views of compression electrodes of the circumferential ring type which include auxiliary means for maintaining compressive stress between a soft, glass-adherent metal layer and a carbon-containing porous glass substrate at elevated use temperatures. FIG. 7 illustrates a split ring compression electrode wherein compressive stress is provided by spring compression means consisting of spring clip 23 which acts to compress split ring 24 onto an underlying soft metal layer. FIG. 7*a* illustrates a split ring compression electrode wherein spring clip 23 is replaced by spring 25. FIG. 7*b* illustrates a preferred form of split ring compression electrode fabricated from a bimetallic strip comprising relatively high expansion metal 26 and relatively low expansion metal 27. A bimetallic split ring compression electrode of this type may be applied cold and will tend to decrease rather than increase in diameter on heating, thereby maintaining compressive stress between an underlying soft metal layer and the cylindrical carbon glass substrate.

Figure 8:
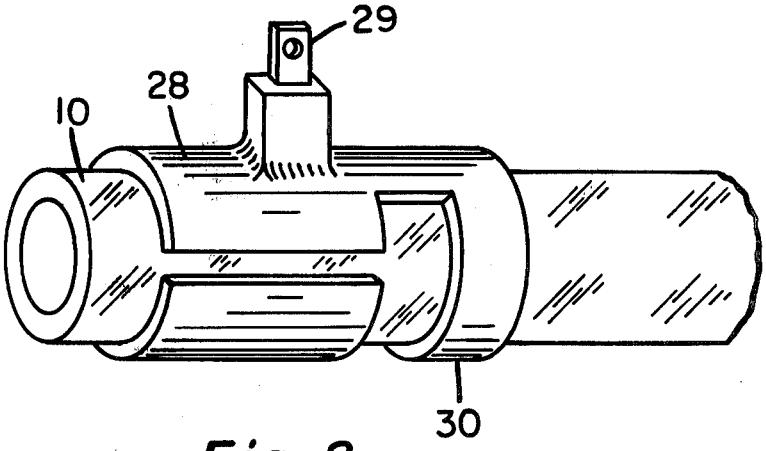
FIG. 8 is a partial schematic view in perspective of an end section of a carbon-containing porous glass tube upon which is provided a compression electrode.

FIG. 8 is a partial schematic view in perspective of an end section of a carbon-containing porous glass tube 10 upon which is provided compression electrode structure 28. The electrode structure includes electrical terminal 29 to which an electric potential may be applied, and appended circumferential ring segment 30 through which the electric potential is transmitted to the carbon phase in tube 10 via an underlying soft metal layer (not shown). Tabs for push-on connectors, such as terminal 29 in FIG. 8, are common electrical connectors which could be applied by welding, soldering or brazing to any of the electrodes shown in FIGS. 1–8.

DETAILED DESCRIPTION

Dependable high temperature contact operation requires that good initial contact between the soft, glass-adherent metal layer and the carbon phase in the glass be provided. The processing of porous glass to provide carbon-containing 96% silica glass in accordance with previously mentioned patents can provide a product wherein the carbon phase is covered by a thin insulating glass surface layer. This layer performs a useful safety function for the operating circuit element, but must be removed in the region where electrical contact with the carbon phase in the glass is to be provided.

Suitable methods for removing this glassy surface layer include etching, for example, with hydrofluoric acid, and grinding or sandblasting away the surface glass with an abrasive. Normally, the removal of about 0.005–0.015 inches of material from the surfaces of conventionally prepared carbon glass will insure adequate contact with the carbon phase therein.

Good long term contact with the exposed carbon phase requires that a glass-adherent metal be used at the glass surface. Since the carbon phase of this material constitutes a relatively small fraction of the volume thereof, the contact surface is mostly glass. A metal which does not wet and adhere to glass will pull away from the glass and carbon phase during high temperature operation.

Cleanliness at the carbon glass/soft metal interface during metal deposition is also essential. If oils, common fluxes, or other contaminants are present in the soft metal or at the glass/metal interface, poor glass-metal bonding and early contact failure will result.

The method of applying the soft metal layer to the carbon glass substrate is not critical, provided that good physical contact between the carbon phase and the metal results. One convenient method comprises electroplating the metal onto the substrate by immersing the substrate in a metal plating bath and passing an electric current through the carbon glass and bath. This method is particularly useful because metal deposition is limited, in the case of glass with an insulating surface skin, to the specific regions etched or abraded for the purpose of contact application. Electroplating may be followed by physical burnishing or a heat treatment to secure good adhesion between the metal and the glass. Of course, alternate methods for applying the soft metal layer, such as dipping, soldering or ultrasonic brushing could also be employed depending upon the particular metal selected for use.

The thickness of the soft metal layer is also not critical, provided that sufficient metal is used to form a continuous layer over the carbon phase. It is desirable to exclude air from the carbon phase, particularly during high temperature contact operation. Of course, the amount of metal needed also depends upon the degree to which the configuration of the compression electrode conforms to that of the contact area. Where conformity is good as, for example, in the case of a cylindrical carbon glass substrate and a closely matched circular ring electrode, a 0.0005 inch thick layer of a metal such as indium is sufficient to provide good electrical contact over many high-temperature thermal cycles.

The selection of a metal for the soft-glass-adherent layer depends upon the intended use of the carbon glass circuit element, and upon the severity of the thermal environment in which the electrical contact is to operate. Indium is a preferred metal from a functional standpoint because, despite a low melting temperature, it is relatively non-reactive with carbon at high temperatures and forms a stable thin film on glass even when molten. However, other metals will also perform satisfactorily at high temperatures, and some may be lower in cost.

The compression electrode may be formed of essentially any electrically conductive solid metal, but the particular metal selected will depend on the type of contact to be employed. In general, low expansion metals or alloys are preferable to high expansion metals, particularly where compression electrodes in the form of unitary circumferential rings are to be applied by shrink-fitting to cylindrical carbon glass substrates. High expansion metal rings which are applied by shrink-fitting can generate compressive stresses on cooling from application temperatures which are sufficient to collapse tubular carbon glass. Preferred metals for electrode fabrication are low-expansion nickel-iron alloys such as, for example, low expansion INVAR® alloy, a nickel-iron alloy having a room temperature thermal expansion of about 0.00015 percent per degree centigrade.

The use of low expansion metal is not as important when flat electrodes or split ring electrodes are used, since compressive stress is maintained by spring tensioning means and is relatively independent of contact temperature. However, the use of low-expansion metal is still preferable to reduce shear stresses which tend to cause contact failure by pulling the underlying soft, adherent metal layer away from the glass.

The application of an electric potential to the compression electrode may be accomplished by any suitable means. Terminals or wires may be permanently attached to the electrode by soldering, brazing or the like, or the electrode may include a contact terminal as an integral part of its structure (e.g., as shown in FIG. 8 of the drawing). A preferred contact method for a cylindrical heating element having compression electrodes which are firmly attached to the carbon glass substrate is a simple electrical fuse holder of conventional design, having spring clips adapted to clip onto the compression electrodes, thereby supporting the heating element while providing an electrical connection therewith.

The following examples will more fully illustrate specific methods for applying and using electrical contacts in accordance with the invention.

EXAMPLE 1

A section of carbon-containing 96% silica glass tubing about 6 inches in length and having an outside diameter of slightly more than one-half inch is selected for contact application. Two circumferential grooves about 0.125 inches in width and 0.013 inches in depth are ground into the tube at opposite ends thereof. Each groove is spaced about 0.4 inches from the tube end adjacent thereto, with the diameter of the tube in the grooves being about 0.502–0.504 inches. Room temperature measurements indicate that the electrical resistance of this tube is in the range of about 10–15 ohms.

A circumferential band of indium is deposited in each groove by an electroplating process. This process comprises immersing each end of the tube into a room temperature electroplating bath consisting of about 50 cc. of a commercially available indium sulfamate plating bath, purchased from the Indium Corporation of America, Utica, N.Y. An electrical current is passed through the bath and tube at a current density of about 10–20 amps per square foot of groove surface area for about 60 minutes. A continuous circumferential band of indium about 0.001 inches in thickness is deposited in the groove by this process. Adherence between the carbon glass and the indium band is improved by burnishing subsequent to eletroplating.

Following the application of indium to each groove, a shim consisting of a split ring formed of 0.009 inch-thick brass sheet stock is positioned over the indium layer in each groove. Thereafter, a compression electrode of the split ring type illustrated in FIG. 7*b* of the drawing, consisting of a bimetallic split ring having an inner diameter of about 0.502 inches and a thickness of about 0.045 inches is positioned over each shim. The bimetal used for this ring was Texas Instruments Type B1 strip, commercially available from Texas Instruments, Inc. Slight expansion of these bimetallic split ring compression electrodes during installation is required to fit them over the tube ends and shims.

Following the application of these compression electrodes, the carbon-containing glass tube is positioned in a fuse-holding assembly having two spring clips, each adapted to clip onto and hold the compression electrode at one end of the tube. Means are provided for applying an electrical potential of 110 volts (60 cycle alternating current) across the clips of the fuse-holding assembly to heat the tube.

The electrical potential is applied to the tube through a thermostat switch which limits heating of the tube by opening at any tube temperature in excess of 235° C. and closing at any tube temperature below 185° C. With an electrical contact provided as described, it is found that contact failure under this cyclical loading is quite rare, even after the tube has been processed through many thousand thermal cycles.

The thermal cycling behavior of a contact such as above described is superior to contacts provided on ground or etched carbon-containing 96% silica glass by ordinary copper plating techniques, or by using silver pastes or graphite cements. These latter contacts typically fail after only a few cycles above 200° C., usually from peeling and/or arcing with localized heating and progressive loss of contact with the carbon phase in the glass.

EXAMPLE 2

A section of carbon-containing 96% silica glass tubing similar in size and configuration to the section treated in Example 1 is provided with circumferential grooves as described in that example. Each end of the tube is then exposed to an indium electroplating bath as in Example 1, except that electroplating is continued for only 60 seconds to provide a continuous but very thin indium film in each groove.

The thin indium films thus provided are physically burnished with a hard plastic probe to insure good adhesion to the glass and contact with the carbon phase. These thin burnished films are quite resistant to peeling during compression electrode installation.

Following the deposition of indium films to each groove as described, two INVAR ® alloy compression electrodes of the split ring type shown in FIG. 6*a* of the drawing, each being provided with indium plating 0.0005 inches in thickness, are slid over the tube ends and into the grooves over the burnished indium films. Each of these compression electrodes and the substrate areas adjacent thereto are then heated to about 300° C., the ends of the electrodes are fastened together by brazing, and the completed contact assemblies are then cooled. The indium plating on each compression electrode acts to fill gaps due to imperfect matching between the electrodes and the indium-plated carbon glass substrate.

Electrical contacts provided in accordance with this example provide excellent high temperature stability when the tube is electrically cycled as described in Example 1.

EXAMPLE 3

A section of carbon-containing 96% silica glass tubing similar in size and configuration to the section treated in Example 1 is provided with end grooves containing circumferential indium bands by utilizing the grinding and electroplating procedure of that example. Expandable compression electrodes composed of nickel-plated copper, each having a lugged configuration as illustrated in FIG. 6*b* of the drawing, are then slipped over each end of the tubing and into the adjacent indium-filled groove.

The lugged compression electrodes and adjacent substrate areas are then heated to a temperature of about 300° C. and relatively cold slugs of INVAR ® alloy, a metal lower in thermal expansion than copper, are inserted between the lugs of each electrode. The electrodes are then cooled. The resulting contact assemblies provide excellent high temperature stability when the tube is electrically cycled as in Example 1.

Stable high temperature performance is also provided by contacts provided as in the above example, but wherein leaf springs exerting an expanding force between the lugs are substituted for the slugs used in each compression electrode. Alternatively, split ring electrode structures comprising auxiliary spring compressing means, such as illustrated in FIGS. 7 and 7*a* of the drawings, may be employed.

Carbon-containing glass which does not include an insulating carbon-free glass skin may be preferred for certain applications, and the removal of surface glass, for example, by cutting grooves to expose the conductive carbon phase, is then not required. Unitary ring compression electrodes of the type shown in FIG. 6 of the drawing are particularly suitable for use with cylindrical carbon glass of this type, since neither shims nor excessive heating during application are required to obtain a compression fit against the ungrooved metal-coated glass surface.

Of course, it will be recognized that the foregoing examples and description are merely illustrative of the many types of high-use-temperature electrical contacts and circuit elements which may be provided within the scope of the invention as defined by the appended claims.

I claim:

1. A high-use-temperature electrical contact for carbon-containing glass which comprises:

(a) a continuous layer of a soft glass-adherent metal positioned on the carbon-containing glass and in contact with a conductive carbon phase therein, the layer providing electrical contact with the carbon phase; and (b) a metallic compression electrode positioned over the layer of soft, glass-adherent metal and in electrical contact therewith, the compression electrode being adapted to maintain compressive stress between the layer and the carbon-containing glass at temperatures up to and including the use temperature of the electrical contact.

2. An electrical contact in accordance with claim 1 wherein the continuous layer is composed of a soft, glass-adherent metal selected from the group consisting of indium, gallium, thallium, lead, and soft metal alloys consisting at least predominantly thereof.

3. An electrical contact in accordance with claim 1 wherein the continuous layer is composed of indium.

4. An electrical circuit element consisting of a carbon-containing glass body to which is attached at least one high-use-temperature electrical contact comprising:

(a) a continuous layer of a soft, glass-adherent metal positioned on the carbon-containing glass body and in contact with a conductive carbon phase therein, the layer providing electrical contact with the carbon phase; and (b) a metallic compression electrode positioned over the layer of soft, glass-adherent metal and in electrical contact therewith, the compression electrode being adapted to maintain compressive stress between the layer and the carbon-containing glass body at temperatures up to and including the use temperature of the electrical contact.

5. An electrical circuit element in accordance with claim 4 wherein the continuous layer of the electrical contact is composed of a soft, glass-adherent metal selected from the group consisting of indium, gallium, thallium, lead, and soft metal alloys consisting at least predominantly thereof.

6. An electrical circuit element in accordance with claim 4 wherein the continuous layer of the electrical contact is composed of indium.

7. An electrical heating element consisting of a cylindrical carbon-containing glass body to which is attached at least one high-use-temperature electrical contact comprising:

(a) a continuous layer of a soft, glass-adherent metal forming a circumferential band around the cylindrical porous glass body and providing electrical contact with a conductive carbon phase therein; and (b) a metallic compression electrode positioned over and in electrical contact with said layer, the compression electrode consisting of a circumferential ring structure adapted to maintain compressive stress between said circumferential band of soft, glass-adherent metal and the carbon-containing glass body at temperatures up to and including the use temperature of the electrical contact.

8. An electrical heating element in accordance with claim 7 wherein the cylindrical carbon-containing glass body is composed of carbon-containing 96% silica glass.

9. An electrical heating element in accordance with claim 8 wherein the cylindrical carbon-containing glass body has as insulating carbon-free glass skin.

10. An electrical heating element in accordance with claim 9 wherein the cylindrical carbon-containing glass body consists of a carbon-containing 96% silica glass tube.

11. An electrical heating element in accordance with claim 10 wherein the continuous layer of soft, glass-adherent metal forming the circumferential band around the cylindrical carbon-containing glass body is composed of a metal selected from the group consisting of indium, gallium, thallium, lead, and soft metal alloys consisting at least predominantly thereof.

12. An electrical heating element in accordance with claim 11 wherein the continuous layer of soft, glass-adherent metal is composed of indium.

13. An electrical heating element in accordance with claim 10 wherein the compression electrode is a circumferential ring composed of a low-expansion nickel-iron alloy.

14. An electrical heating element in accordance with claim 10 wherein the compression electrode is a circumferential split ring.

15. An electrical heating element in accordance with claim 10 wherein the compression electrode is a circumferential split ring, and wherein compressive stress is provided by auxiliary spring compression means.

16. An electrical heating element in accordance with claim 10 wherein the compression electrode is a circumferential split ring formed from bimetallic strip, which ring tends to decrease in diameter on heating.

17. An electrical heating element in accordance with claim 16 wherein a shim consisting of a metallic circumferential split ring is provided between the soft, glass-adherent metal layer and the compression electrode.

* * * * *